US009481074B2

(12) United States Patent
Lesche

(10) Patent No.: US 9,481,074 B2
(45) Date of Patent: Nov. 1, 2016

(54) LOCKING PLIER JAWS

(71) Applicants: Bosch Automotive Service Solutions LLC, Warren, MI (US); Robert Bosch GmbH, Stuttgart (DE)

(72) Inventor: George Lesche, Bridgetown, NJ (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 364 days.

(21) Appl. No.: 14/158,362

(22) Filed: Jan. 17, 2014

(65) Prior Publication Data

US 2014/0208898 A1 Jul. 31, 2014

Related U.S. Application Data

(60) Provisional application No. 61/757,164, filed on Jan. 27, 2013.

(51) Int. Cl.
*B25B 7/04* (2006.01)
*B25B 5/16* (2006.01)
(Continued)

(52) U.S. Cl.
CPC ..... *B25B 7/04* (2013.01); *B25B 5/147* (2013.01); *B25B 5/163* (2013.01); *B25B 7/123* (2013.01); *B25B 27/10* (2013.01); *B25B 27/146* (2013.01); *Y10T 29/49826* (2015.01)

(58) Field of Classification Search
CPC ..... B25B 5/147; B25B 5/163; B25B 7/02; B25B 7/04; B25B 7/123; B25B 27/10; B25B 27/146
USPC ..... 81/423, 424.5; 269/6, 9, 257
See application file for complete search history.

(56) References Cited

U.S. PATENT DOCUMENTS 1,766,459 A * 6/1930 Schweigert ..... B25B 7/02 81/186
2,637,236 A * 5/1953 Vergnani et al. ..... B25B 7/04 81/186

(Continued)

FOREIGN PATENT DOCUMENTS

DE 3421986 A1 12/1985
DE 4343348 A1 6/1995

(Continued)

OTHER PUBLICATIONS

International Search Report and Written Opinion corresponding to PCT Application No. PCT/US2014/013087, mailed Jun. 12, 2014 (10 pages).

*Primary Examiner* — David B Thomas
(74) *Attorney, Agent, or Firm* — Maginot Moore & Beck LLP

(57) ABSTRACT

A hand tool assembly in one embodiment includes a pair of pivotable jaws, a first jaw mounted component, and a second jaw mounted component. The first jaw mounted component includes a first mounting portion that removably mounts the first jaw mounted component on a first of the pair of pivotable jaws. The second jaw mounted component includes second mounting portion that removably mounts the second jaw mounted component on a second of the pair of pivotable jaws. A first working surface of the first jaw mounted component and a second working surface of the second jaw mounted component define a channel when the first working surface is placed in direct opposition to the second working surface. The channel is complementary to the outer surface of a tubular work-piece and is configured to hold or work the work-piece when the pivotable jaws are pivoted to a clamped position.

19 Claims, 9 Drawing Sheets

(51) Int. Cl.

| | |
|---|---|
| ***B25B 5/14*** | (2006.01) |
| ***B25B 7/12*** | (2006.01) |
| ***B25B 27/10*** | (2006.01) |
| ***B25B 27/14*** | (2006.01) |

(56) References Cited

U.S. PATENT DOCUMENTS 2,714,321 A * 8/1955 Tamplin ..... B25B 7/02 81/185.1
2,814,222 A * 11/1957 Sanders ..... H01R 43/042 72/409.12
3,585,704 A * 6/1971 Schroeder ..... B25B 7/02 269/2
3,635,107 A * 1/1972 Schmidt ..... B25B 7/02 81/367
3,833,210 A 9/1974 Kotter
3,884,100 A * 5/1975 Fideldy ..... B25B 7/02 81/367
4,583,671 A * 4/1986 Cressy ..... B25B 7/04 227/144
5,143,359 A * 9/1992 Bush ..... B25B 5/163 269/261
5,168,783 A * 12/1992 Shea ..... B25B 7/02 81/418
5,291,914 A * 3/1994 Bares ..... B25B 7/02 137/15.13
5,305,669 A * 4/1994 Kimbro ..... B25B 7/00 81/423
5,373,866 A * 12/1994 Whalen, II ..... B25B 7/14 137/318
6,336,386 B1 * 1/2002 Lee ..... B25B 7/18 269/6
6,389,937 B1 * 5/2002 Kang ..... B25B 7/04 81/423
6,477,925 B2 * 11/2002 Lin ..... B25B 7/04 81/185.1
7,373,862 B2 * 5/2008 Tyler ..... B25B 5/12 81/367
7,878,790 B2 * 2/2011 Kidd ..... B21D 39/046 425/318
7,954,356 B1 * 6/2011 Erbrick ..... B21D 39/048 72/409.12
8,328,170 B2 * 12/2012 Wasinger ..... B25B 7/02 269/216
8,516,931 B2 * 8/2013 Steele ..... B25B 7/10 81/409
2007/0200379 A1 * 8/2007 Key ..... B25B 5/061 294/198
2009/0293577 A1 * 12/2009 Hamm ..... B25B 7/02 72/416
2010/0018365 A1 1/2010 Tyler
2010/0101379 A1 * 4/2010 Hofmann ..... B25B 7/02 81/423
2011/0302764 A1 * 12/2011 Smith ..... B25B 7/02 29/505
2012/0042710 A1 * 2/2012 Polofsky ..... B25B 7/04 72/409.16

FOREIGN PATENT DOCUMENTS

DE 29514265 U1 12/1995
DE 19610899 C1 7/1997
DE 20200733 U1 5/2002

* cited by examiner

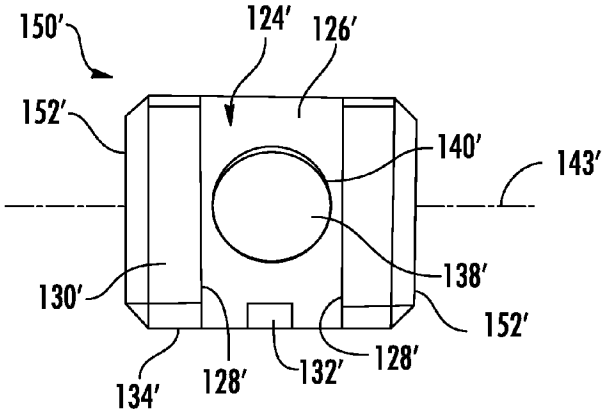
FIG. 17
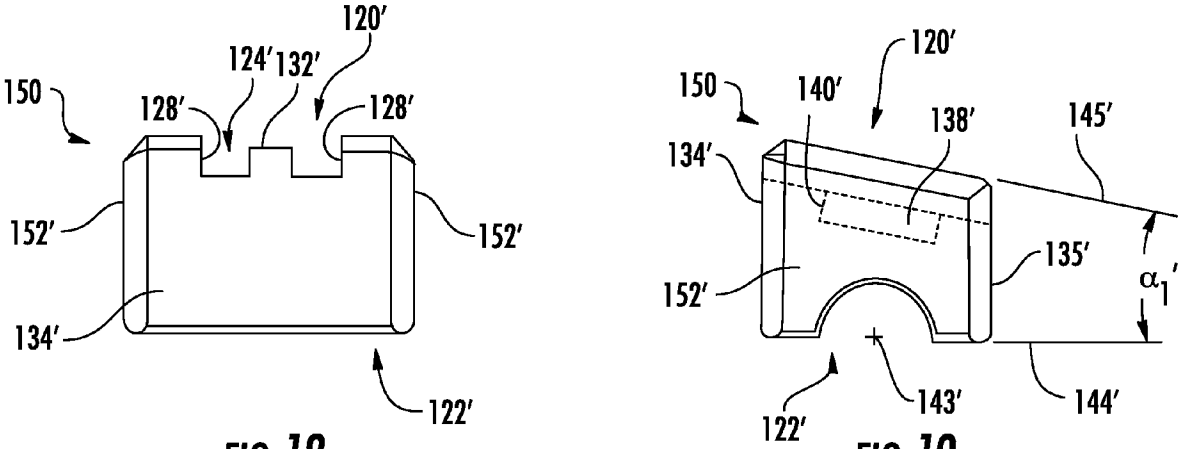
FIG. 18
FIG. 19

LOCKING PLIER JAWS

This application claims the benefit of U.S. Provisional Application No. 61/757,164, filed Jan. 27, 2013, the entire contents of which are herein incorporated by reference.

FIELD OF THE INVENTION

The present disclosure relates generally to devices for working objects and, more particularly, to devices for restraining, stabilizing, cutting, crimping, or resizing tubular objects.

BACKGROUND

A wide variety of tools are currently available to plumbers and other workers that are used to either hold, cut, crimp, or reshape objects, such as pipe. However, none of these existing tools provide all-in-one functionality and the simplicity of a single device. The current state of the art in pipe holders and/or shapers generally requires the use of multiple tools, each of various shapes and sizes depending upon need. Transporting multiple tools becomes a cumbersome process because it requires the worker to carry multiple tools resulting in additional weight. The added weight quickly results in worker fatigue especially for those workers that must transport multiple tools within a job site or between job sites. Therefore, improvements to devices for holding or working tubular objects that enable a single device to perform a variety of functions on the objects are desirable. Improvements to devices for holding or working tubular objects that reduce the weight problem associated with multiple tools are also desirable.

SUMMARY

A hand tool assembly in one embodiment includes a pair of pivotable jaws, a first jaw mounted component including a first mounting portion configured to removably mount the first jaw mounted component on a first of the pair of pivotable jaws, and a first working surface generally opposite the first mounting portion, and a second jaw mounted component including a second mounting portion configured to removably mount the second jaw mounted component on a second of the pair of pivotable jaws, and a second working surface generally opposite the second mounting portion, wherein a channel defined by placing the first working surface in direct opposition to the second working surface is complementary to the outer surface of a tubular work-piece.

A kit for forming a hand tool assembly includes a pair of pivotable jaws, a first jaw mounted component including a first mounting portion configured to removably mount the first jaw mounted component on a first of the pair of pivotable jaws, and a first working surface generally opposite the first mounting portion, a second jaw mounted component including a second mounting portion configured to removably mount the second jaw mounted component on a second of the pair of pivotable jaws, and a second working surface generally opposite the second mounting portion, a third jaw mounted component including a third mounting portion configured to removably mount the third jaw mounted component on the first of the pair of pivotable jaws, and a third working surface generally opposite the third mounting portion, and a fourth jaw mounted component including a fourth mounting portion configured to removably mount the fourth jaw mounted component on the second of the pair of pivotable jaws, and a fourth working surface generally opposite the fourth mounting portion, wherein a first channel defined by placing the first working surface in direct opposition to the second working surface is complementary to the outer surface of a first tubular work-piece, a second channel defined by placing the third working surface in direct opposition to the fourth working surface is complementary to the outer surface of a second tubular work-piece, and a diameter of the first channel is different than a diameter of the second channel.

A method of operating a hand tool assembly includes opening a pair of pivotable jaws, attaching a first jaw mounted component on a first of the pair of pivotable jaws, the first jaw mounted component including a first mounting portion configured to removably mount the first jaw mounted component on the first of the pair of pivotable jaws, and a first working surface generally opposite the first mounting portion, attaching a second jaw mounted component on a second of the pair of pivotable jaws, the second jaw mounted component including a second mounting portion configured to removably mount the second jaw mounted component on the second of the pair of pivotable jaws, and a second working surface generally opposite the second mounting portion, and retaining a tubular work-piece in a channel defined by placing the first working surface in direct opposition to the second working surface, wherein the first working surface is placed in direction opposition to the second working surface by pivoting the pair of pivotable jaws, and the channel is complementary to the outer surface of the tubular work-piece after pivoting the pair of pivotable jaws.

BRIEF DESCRIPTION OF THE DRAWINGS

FIGS. 17-19 are plan views of the first jaw mounted component of FIGS. 14-16 from the top, the front, and the side of the first jaw mounted component.

DETAILED DESCRIPTION

Figure 1:
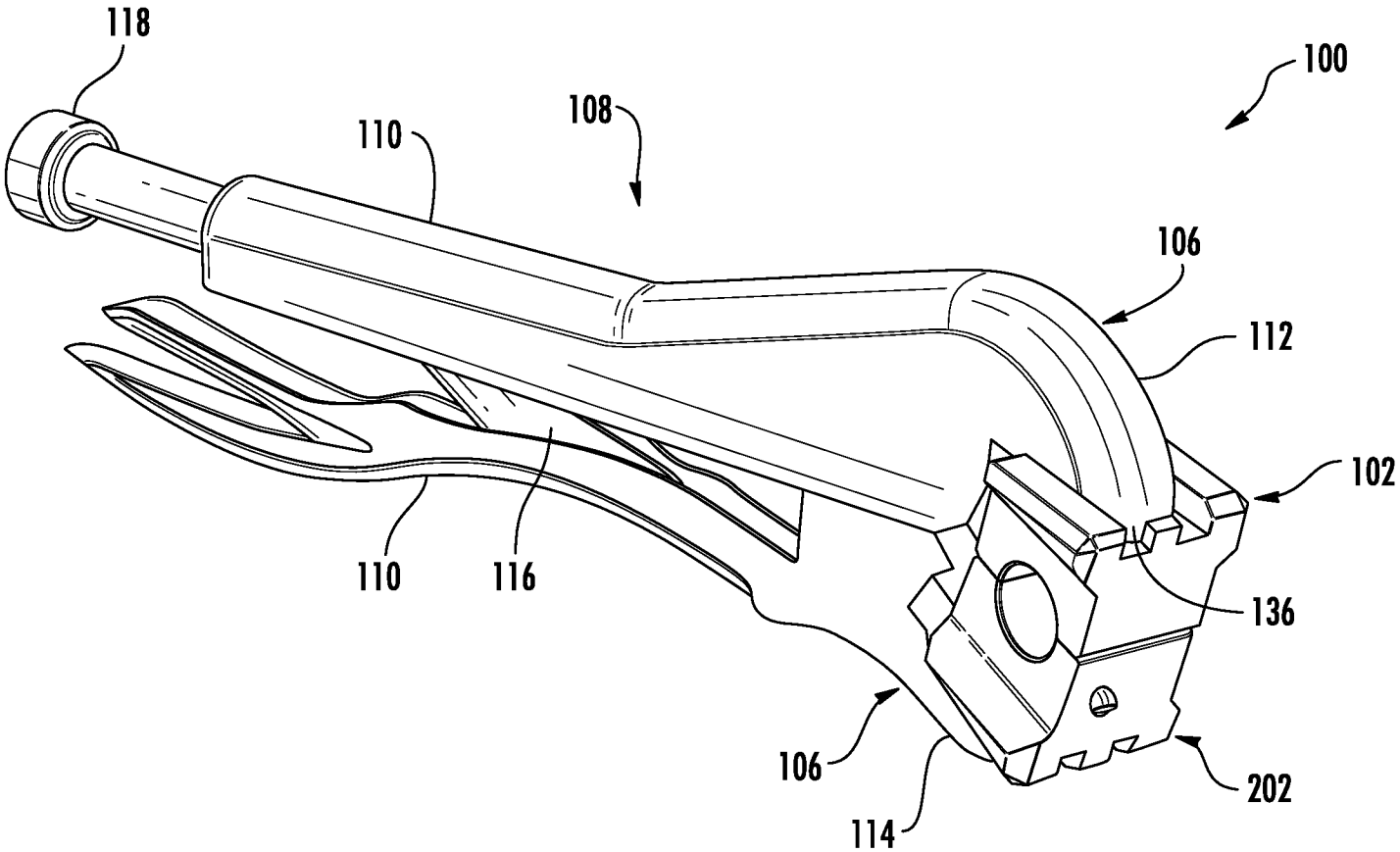
FIG. 1 is a side-perspective view of a first embodiment of a pair of jaw mounted components positioned on pivotable jaws of a vice grip.

For the purpose of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one skilled in the art to which this disclosure pertains.

FIG. 1 shows a hand tool assembly 100 configured to hold or work a work-piece. The tool assembly 100 includes a first jaw mounted component 102 and a second jaw mounted component 202 attached to a pair of pivotable jaws 106. In the embodiment shown, the pivotable jaws 106 are similar to the jaws of a typical locking plier-type wrench or vice grip 108 that is widely available to the public. Such a vice grip 108 typically includes a handle 110 with a fixed jaw (such as a first jaw 112 of the pair of pivotable jaws 106), a movable jaw (such as a second jaw 114 of the pair of pivotable jaws 106) pivoted to the handle 110 opposite the fixed jaw 112 for clamping a work piece between the jaws 112 and 114, and a toggle mechanism 116 arranged and pivotally connected to the handle 110 and to the movable jaw 114 for over-center locking of the jaws 112 and 114 on the work piece. The vice grip 108 also includes a screw operator 118 that cooperates with a lever portion of the toggle mechanism 116 for adjustment of the jaws 112 and 114 to enable such clamping and over-center toggle locking action on work pieces of different dimensions. Further details of common locking plier-type wrenches are generally described in U.S. Pat. Nos. 2,280,005, 2,514,130, and 2,966,818, the entire contents of which are herein incorporated by reference.

Figure 2:
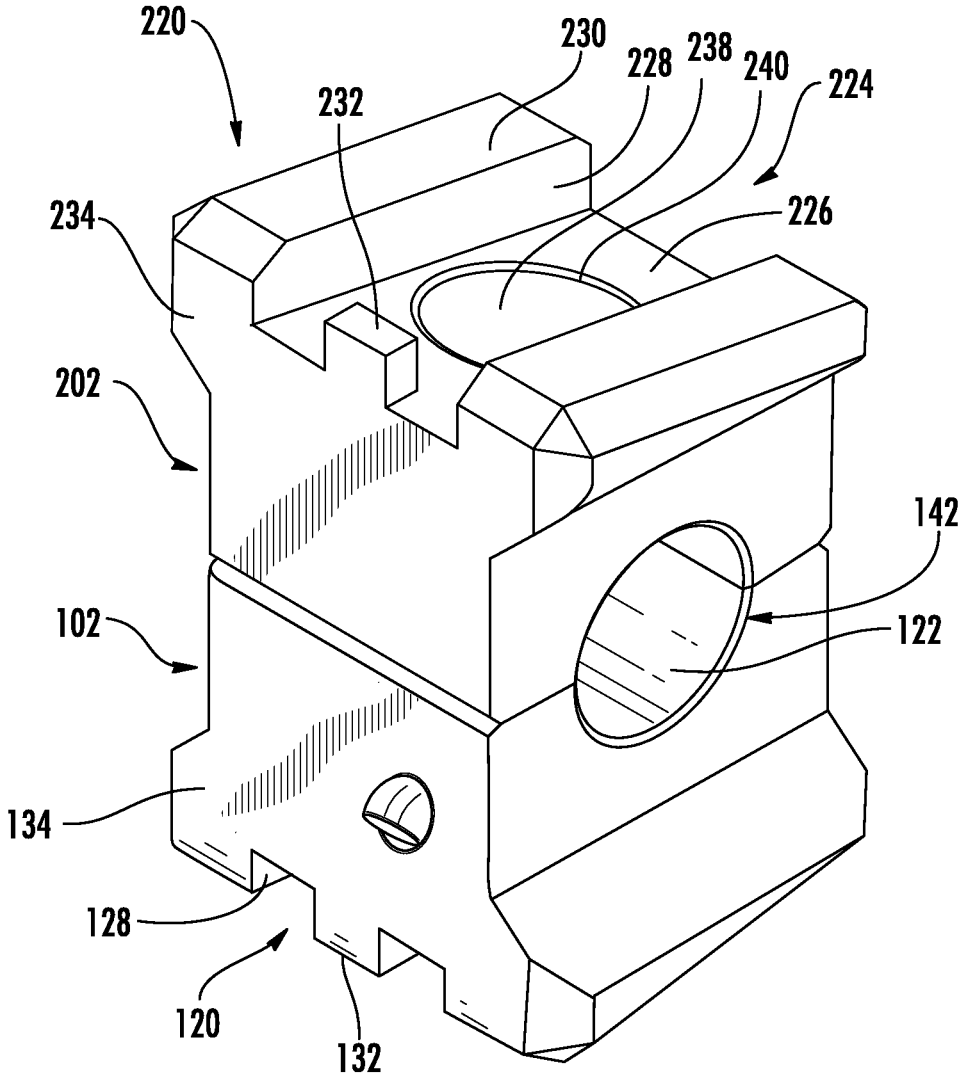
FIG. 2 is a different side-perspective view of the jaw mounted components of FIG. 1.
Figure 5:
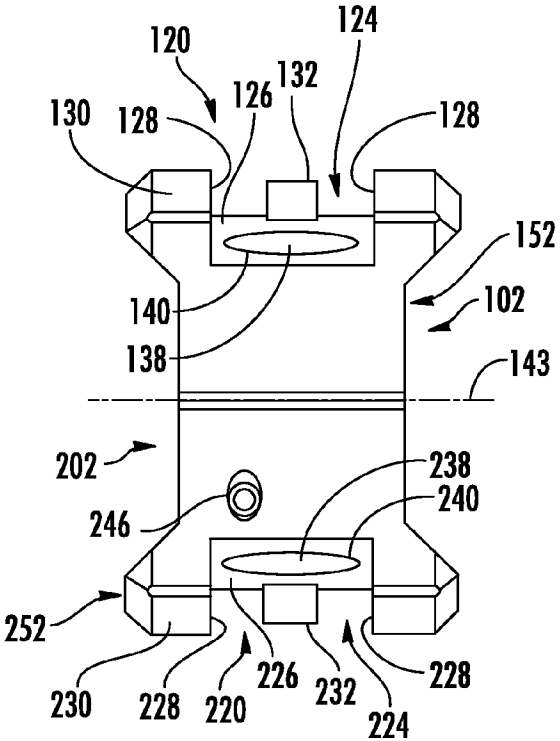
FIGS. 3-5 are plan views of the jaw mounted components of FIG. 1 from the front, the side, and the back of the jaw mounted components.
Figure 4:
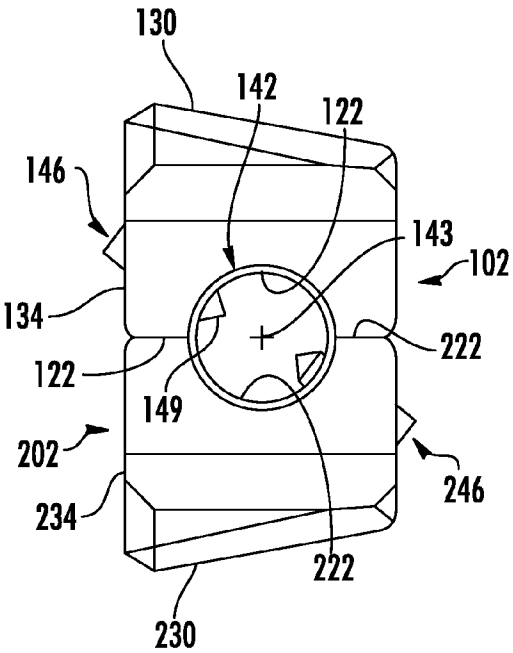
Figure 3:
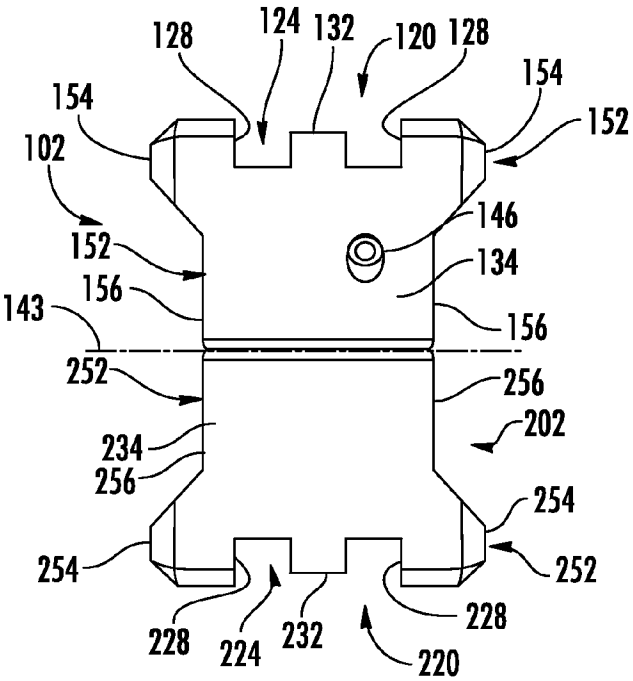
Figure 6:
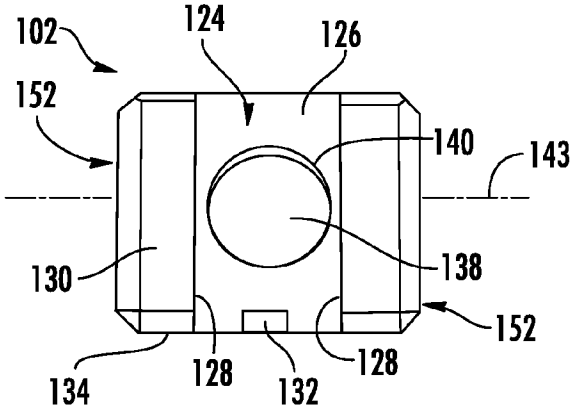
FIGS. 6-9 are plan views of a first jaw mounted component of the jaw mounted components of FIG. 1 from the top, the front, the side, and the back of the first jaw mounted component.
Figure 9:
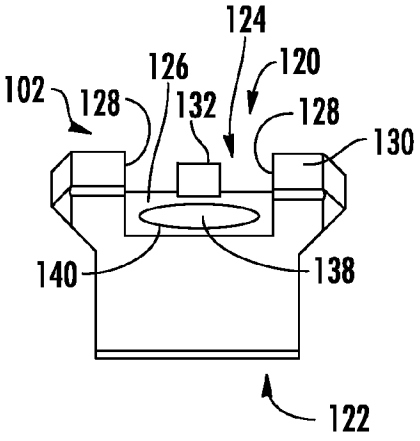

FIG. 2 shows a side-perspective view and FIGS. 3-5 show respective front, side, and back plan views of the first jaw mounted component 102 and the second jaw mounted component 202 as arranged between the pivotable jaws 106 in a clamped position of the vice grip 108 as shown in FIG. 1. The following discussion of the features of the first jaw mounted component 102 and the second jaw mounted component 202 is made with further reference to FIGS. 6-9 for the first jaw mounted component 102 and to FIGS. 10-13 for the second jaw mounted component 202. Since the first jaw mounted component 102 and the second jaw mounted component 202 are substantially symmetrical in at least some embodiments, reference numerals for features shown on the second jaw mounted component 202 that are similar to features shown on the first jaw mounted component 102 are incremented by 100 to illustrate such symmetry.

The first jaw mounted component 102 includes a first mounting portion 120 configured to removably mount the first jaw mounted component 102 on the first jaw 112 of the pair of pivotable jaws 106. In the embodiment shown, the first mounting portion 120 includes a slot 124 defined by a slot bottom 126 and at least two slot sides 128. The slot bottom 126 is positioned opposite the first jaw 112 of the pair of pivotable jaws 106 when the first jaw mounted component 102 is mounted on the first jaw 112. The spacing of the slot sides 128 from one another defines a width of the slot 124 that is slightly greater than a width of the first jaw 112. The spacing of slot sides 128 enables the first jaw 112 to slide within the slot 124 when the first jaw mounted component 102 is mounted on the first jaw 112. Similarly, the spacing of the slot bottom 126 from an outer face 130 of the first mounting portion 120 defines a depth of the slot 126 that is configured to ensure the first jaw 112 remains within the slot 124 as the first jaw mounted component 102 is mounted on the first jaw 112.

The first mounting portion 120 further includes a stop 132 extending from the slot bottom 126 of the slot 124. In the embodiment shown, the stop 132 is positioned between the slot sides 128 with at least a portion of the stop 132 adjacent to a front face 134 of the first jaw mounted component 102. During the mounting of the first jaw mounted component 102 on the first jaw 112 of the pair of pivotable jaws 106, the first jaw mounted component 102 is configured to slide relative to the first jaw 112 until a tip 136 of the first jaw 112 contacts the stop 132. The contact of the tip 136 of the first jaw 112 with the stop 132 in this embodiment provides positive indication that the first jaw mounted component 102 is fully engaged with the first jaw 112 of the pivotable jaws 106.

Similar to the first jaw mounted component 102, the second jaw mounted component 202 includes a second mounting portion 220 configured to removably mount the second jaw mounted component 202 on the second jaw 114 of the pair of pivotable jaws 106. In the embodiment shown, the second mounting portion 220 includes a slot 224 defined by a slot bottom 226 and at least two slot sides 228. The slot bottom 226 is positioned opposite the second jaw 114 of the pair of pivotable jaws 106 when the second jaw mounted component 202 is mounted on the second jaw 114. The spacing of the slot sides 228 from one another defines a width of the slot 224 that is slightly greater than a width of the second jaw 114. The spacing of slot sides 228 enables the second jaw 114 to slide within the slot 224 when the second jaw mounted component 202 is mounted on the second jaw 114. Similarly, the spacing of the slot bottom 226 from an outer face 230 of the second mounting portion 220 defines a depth of the slot 226 that is configured to ensure the second jaw 114 remains within the slot 224 as the second jaw mounted component 202 is mounted on the second jaw 114.

The second mounting portion 220 further includes a stop 232 extending from the slot bottom 226 of the slot 224. In the embodiment shown, the stop 232 is positioned between the slot sides 228 with at least a portion of the stop 232 adjacent to a front face 234 of the second jaw mounted component 202. During the mounting of the second jaw mounted component 202 on the second jaw 114 of the pair of pivotable jaws 106, the second jaw mounted component 202 is configured to slide relative to the second jaw 114 until a tip 236 of the second jaw 114 contacts the stop 232. The contact of the tip 236 of the second jaw 114 with the stop 232 in this embodiment provides positive indication that the second jaw mounted component 202 is fully engaged with the second jaw 114 of the pivotable jaws 106.

The first jaw mounted component 102 and the second jaw mounted component 202 are configured to utilize magnetic force to facilitate retention of the first and the second jaw mounted components 102 and 202 on the pivotable jaws 106. In some embodiments of the hand tool assembly 100, the pivotable jaws 106 are formed with a magnetic material. In these embodiments, the first mounting portion 120 of the first jaw mounted component 102 includes a first magnet 138 and the second mounting portion 220 of the second jaw mounted component 202 includes a second magnet 238. As shown in the figures, the first magnet 138 is positioned within a first depression 140 in the slot bottom 126 of the first mounting portion 120 and the second magnet 238 is positioned within a second depression 240 in the slot bottom 226 of the second mounting portion 220.

The positioning of the first and the second magnets 138 and 238 in the respective first and the second depressions 140 and 240 ensures that the magnets remain proximate to the pivotable jaws 106 during assembly of the first and the second jaw mounted components on the pivotable jaw 106. The positioning of the magnets 138 and 238 also ensures that the pivotable jaws 106 do not damage the magnets during use of the hand tool assembly 100. In other embodiments, the first mounting portion 120 includes a first magnetic material and the second mounting portion 220 includes a second magnetic material. The first and the second jaws 112 and 114 in these other embodiments include the respective first and the second magnets to facilitate retention of the first and the second jaw mounted components 102 and 202 on the pivotable jaws 106. The magnets in some embodiments are neodymium magnets of a grade of N42. The strength of the magnets is selected such that the first and the second jaw mounted components 102 and 202 maintain a firm connection to the pivotable jaws 106 once mounted, but also that the first and the second jaw mounted components 102 and 202 do not become permanently affixed to the pivotable jaws 106.

The first jaw mounted component 102 further includes a first working surface 122 generally opposite the first mounting portion 120, and the second jaw mounted component 202 further includes a second working surface 222 generally opposite the second mounting portion 220. The first working surface 122 and the second working surface 222 define a channel 142 for contacting a work-piece when the working surfaces 122 and 222 of the jaw mounted components 102 and 202 are placed in direct opposition to one another. The channel 142 is generally configured to be complementary to the outer surface of a tubular work-piece that is to be held or worked by the hand tool assembly 100.

The term "direct opposition" as used herein means a positional arrangement of the first and the second jaw mounted components 102 and 202 in which features of the first working surface 122 are substantially aligned with features of the second working surface 222 so as to define the channel with a continuous predetermined geometry. The term "direct opposition" also means a positional arrangement of the first and the second jaw mounted components 102 and 202 in which further pivoting of the pivotable jaws 106 is prevented because at least some portions of the first and the second working surfaces 122 and 222 are in contact with each other. In some embodiments, the first and the second jaw mounted components 102 and 202 are formed from metal that is case-hardened to withstand the compressive forces generated between the work-piece and the pivotable jaws 106. In other embodiments, the first and the second jaw mounted components 102 and 202 are formed from alternative materials, such as composites, that have similar strength properties, but that weigh substantially less than components formed from case-hardened metal.

In some embodiments of the first and the second jaw mounted components 102 and 202, the channel 142 has a diameter that is substantially identical to the diameter of a commercially available tubular work-piece to be held or worked. The diameter of the channel 142 formed by the first and the second working surfaces 122 and 222 in these embodiments ensures sufficient friction is generated between the channel defining surfaces of the working surfaces 122 and 222 and the surfaces of the tubular work-piece to substantially prevent axial or radial movement of the work-piece relative to the first and the second jaw mounted components 102 and 202. The size of the channel 142 in these embodiments also substantially prevents permanent deformation of the tubular work-piece when the physical dimensions of the work-piece are substantially identical to the dimensions of an ideal commercially available tubular work-piece.

The term "commercially available tubular work-piece" as used herein means a tubular work-piece that is manufactured to a nominal outer diameter which typically varies plus and minus depending on a tolerance range. The term "ideal commercially available tubular work-piece" means a commercially available tubular work-piece that has an outer diameter within the tolerance range. In the case of a work-piece that has an outer diameter outside the tolerance range of the commercially available product, the placing of the first and the second working surfaces 122 and 222 in opposition to one another may work the work-piece and permanently deform portions of the work-piece such that the outer diameter is within the tolerance of the commercially available tubular work-piece once the work piece is released from the hand tool assembly 100.

In other embodiments of the first and the second jaw mounted components 102 and 202, the channel 142 has a diameter that is slightly less than the diameter of the commercially available tubular work-piece. The first and the second working surfaces 122 and 222 in these embodiments are not only configured to substantially prevent relative movement of the work-piece, but are further configured to permanently deform at least some portions of the tubular work-piece when the physical dimensions of the work-piece are substantially identical to the dimensions of an ideal commercially available tubular work-piece. Such permanent deformation of the work-piece may be useful for crimping portions of the work-piece and/or for coupling two or more tubular work-pieces together.

Figure 8:
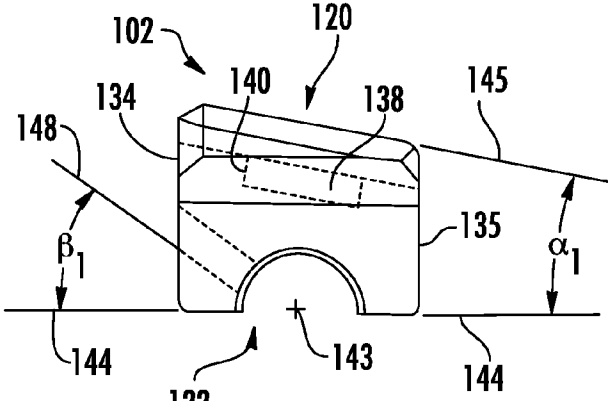
Figure 7:
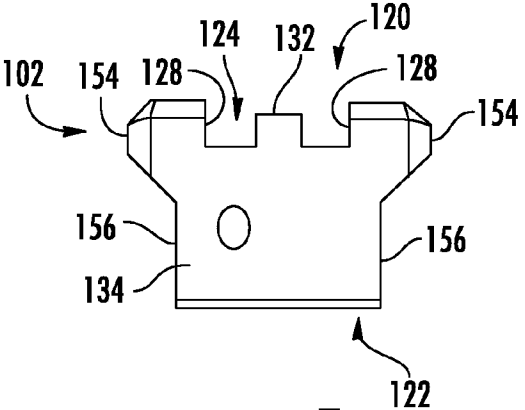
Figure 10:
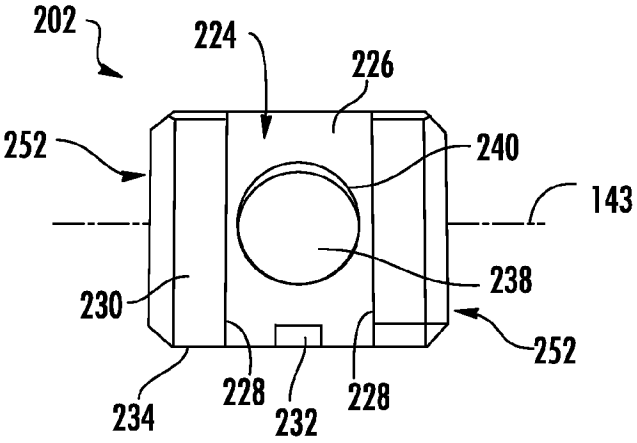
FIGS. 10-13 are plan views of a second jaw mounted component of the jaw mounted components of FIG. 1 from the top, the front, the side, and the back of the second jaw mounted component.
Figure 13:
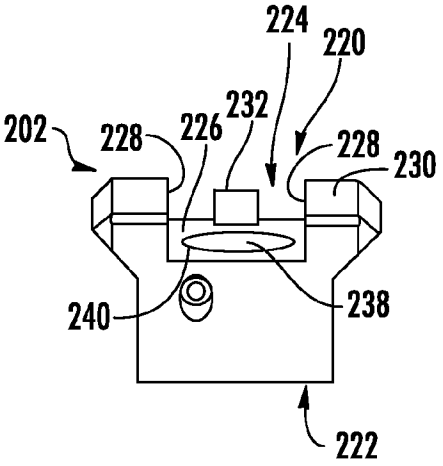
Figure 12:
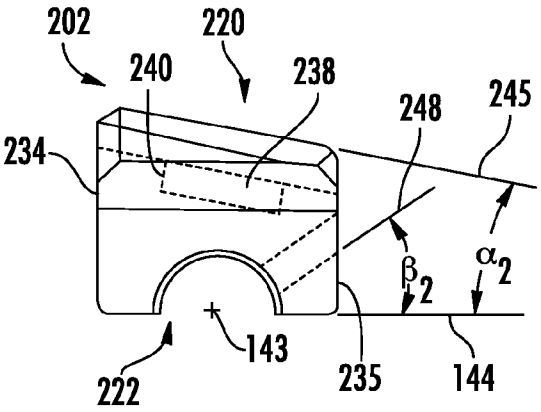
Figure 11:
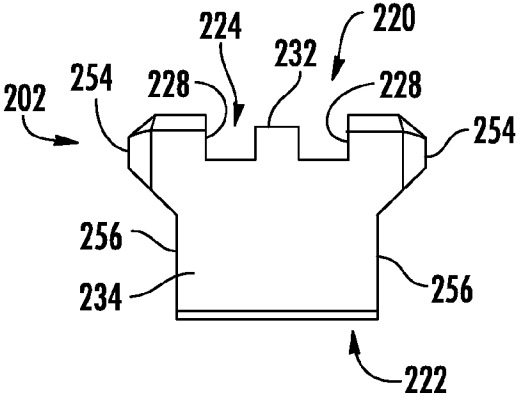
Figure 14:
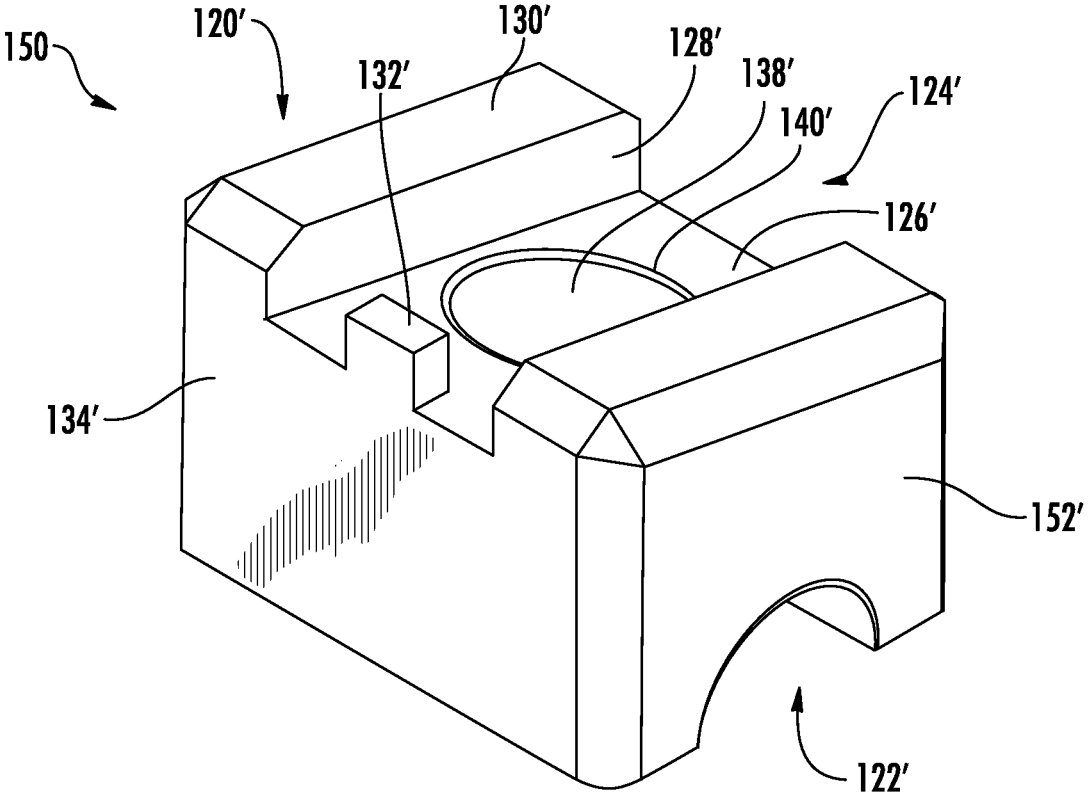
FIG. 14 is a side-perspective view of a first jaw mounted component of a second embodiment of a pair of jaw mounted components that configured to be positioned on the pivotable jaws of the vice grip.
Figure 16:
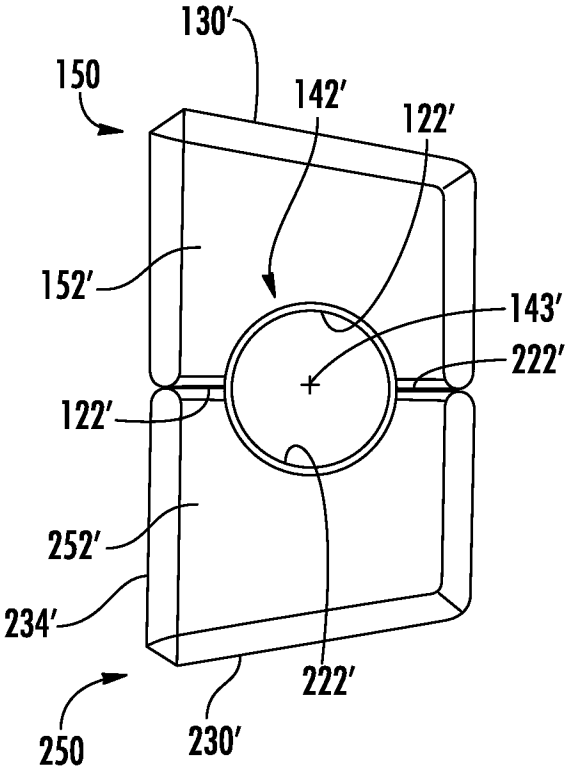
FIGS. 15 and 16 are plan views of the second embodiment of the pair of jaw mounted components from the front and the side of the jaw mounted components.

The features of the first and the second jaw mounted components 102 and 202 define useful reference geometry for depicting the positional relationships of the various features of the hand tool assembly 100. For simplicity, reference geometry common to both the first and the second jaw mounted components 102 and 202 is identified only with a single reference numeral. With particular reference to FIGS. 4, 8, and 12, the channel 142 defined by the first working surface 122 of the first jaw mounted component 102 and the second working surface 222 of the second jaw mounted component 202 defines a channel axis 143 passing through the first and the second jaw mounted components 102 and 202. The pair of pivotable jaws 106 to which the first and the second jaw mounted components 102 and 202 are respectively mounted defines a pivot axis about which the first and the second jaws 112 and 114 pivot.

The channel axis 143 of the channel 142 and the pivot axis of the pivotable jaws 106 define a first plane 144 extending between the axes. The first mounting portion 120 of the first jaw mounted component 102 defines a first mounting portion plane 145 that intersect the first plane 144, and the second mounting portion 220 of the second jaw mounted component 202 defines a second mounting portion plane 245 that intersect the first plane 144. In at least one embodiment, the angle ($\alpha_1$) between the first mounting portion plane 145 and the first plane 144 and the angle ($\alpha_2$) between the second mounting portion plane 245 and the first plane 144 is approximately 10 degrees. In other embodiments, the angle ($\alpha_1$) between first mounting portion plane 145 and the first plane 144 and the angle ($\alpha_2$) between the second mounting portion plane 245 and the first plane 144 is greater or lesser than 10 degrees. In some embodiments, the respective slot bottoms 126 and 226 of the first and the second mounting portions 120 and 220 define the respective first and the second mounting portion planes 145 and 245.

In some embodiments of the hand tool assembly 100, the first jaw mounted component 102 includes a first threaded member 146 configured to retractably extend within the channel 142 from the first jaw mounted component 102. The first threaded member 146 in some of these embodiments is used to further prevent relative motion of the work-piece within the channel 142. In other of these embodiments, the first threaded member 146 is used to work the work-piece by locally puncturing and/or deforming portions of the work-piece while the work-piece is clamped within the hand tool assembly 100.

As best shown in FIG. 4 and FIG. 8, the first threaded member 146 cooperates with a first threaded bore 147 extending from the front face 134 of the first jaw mounted component 102 to the first working surface 122. The first threaded bore 147 in the embodiment shown defines a longitudinal axis 148 that forms an angle ($\beta_1$) with the first plane 144 of approximately 35 degrees. In other embodiments, the angle ($\beta_1$) between the longitudinal axis 148 and the first plane is greater or lesser than 35 degrees. Although the first threaded member 146 is shown in FIG. 4 as a dog point set screw with a pointed tip portion 149, other types of threaded members with different tip configurations may be used in the hand tool assembly 100.

As best shown in FIG. 4 and FIG. 12, the second jaw mounted component 202 in some embodiments includes a second threaded member 246 configured to retractably extend within the channel 142 from the second jaw mounted component 202. Similar to the first threaded member 146, the second threaded member 246 can be used to further prevent relative motion of the work-piece within the channel 142 or to work the work-piece by locally puncturing and/or deforming portions of the work-piece while the work-piece is clamped within the hand tool assembly 100. The second threaded member 246 cooperates with a second threaded bore 247 extending from a back face 235 of the second jaw mounted component 202 to the second working surface 222. The second threaded bore 247 defines a longitudinal axis 248 that forms an angle ($\beta_2$) with the first plane 144 of approximately 35 degrees. In other embodiments, the angle ($\beta_2$) between the longitudinal axis 248 and the first plane 144 is greater or lesser than 35 degrees.

Figure 15:
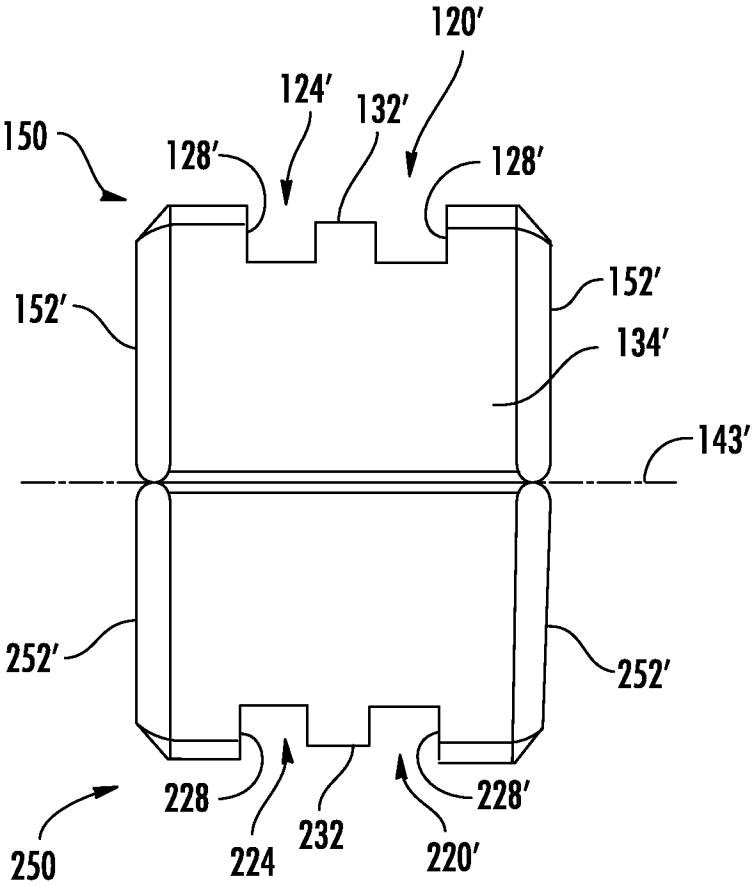

FIGS. 14-19 show an alternative embodiment of the first and the second jaw mounted components 102 and 202 of FIGS. 1-13. Reference numerals for features of the alternative embodiment that correspond to features of the first and the second jaw mounted components 102 and 202 of FIGS. 1-13 are shown with a prime symbol ('), while unique features of the alternative embodiments are given unique reference numerals. As best shown in FIGS. 15, 18, and 19, the first jaw mounted component 150 of the alternative embodiment has first side faces 152' extending substantially in parallel from the outer face 130' of the first mounting portion 120' to the first plane 144'. With particular reference now to FIG. 15, the second jaw mounted component 250 of the alternative embodiment has second side faces 252' extending substantially in parallel from the outer face 230' of the second mounting portion 220' to the first plane 144'. The spacing between the first side faces 152' of the first jaw mounted component 150 and between the second side faces 252' of the second jaw mounted component 250 is approximately equal such that each of the side faces 152' and 252' forms a substantially continuous face across both the first jaw mounted component 150 and the second jaw mounted component 250.

Referring now FIGS. 3-13, the first jaw mounted component 102 has first side faces 152 extending substantially in parallel from the outer face 130 of the first mounting portion 120 to the first plane 144. The first side faces 152 have a first portion 154 proximate to the first mounting portion 120 and a second portion 156 proximate to the first working surface 122. The spacing between the second portion 156 of the first side faces 152 is less than the spacing between the first portion 154 of the first side faces 152. Similarly, the second jaw mounted component 202 has second side faces 252 extending substantially in parallel from the outer face 230 of the second mounting portion 220 to the first plane 144. The second side faces 252 have a first portion 254 proximate to the second mounting portion 220 and a second portion 256 proximate to the second working surface 222. The spacing between the second portion 256 of the second side faces 252 is less than the spacing between the first portion 254 of the second side faces 252.

The spacing between the second portion 156 of the first side faces 152 is approximately equal to the spacing between the second portion 256 of the second side faces 252. The spacing of the respective second portions 156 and 256 of the first and the second side faces 152 and 252 of the first and the second jaw mounted components 102 and 202 is less than the spacing between the respective first side faces and the second side faces 152' and 252' of the first and the second jaw mounted components 150 and 250 of the alternative embodiment. The larger spacing between the respective first and the second side faces 152' and 252' of the alternative embodiment components 150 and 250 provides the channel 142' with more surface area in which to contact the work-piece. Contrarily, the smaller spacing between the respective second portions 156 and 256 of the first and the second side faces 152 and 252 provides the channel 142 with less surface area in which to contact the work-piece.

Figure 20:
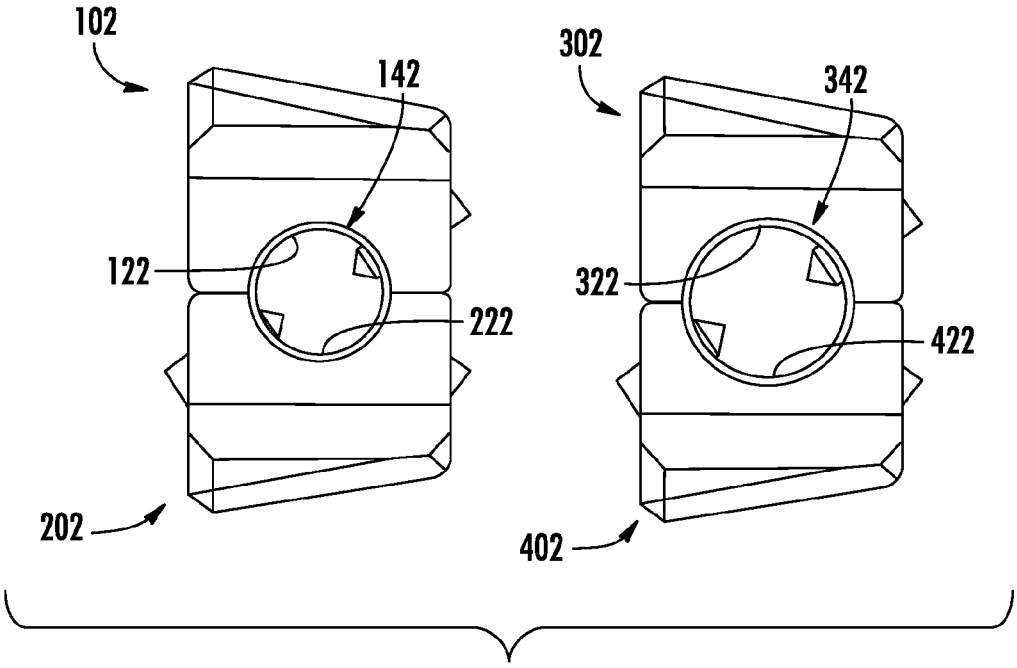
FIG. 20 is side-plan view of two pairs of jaw mounted components used in a kit for forming a hand tool assembly.

FIG. 20 shows two pairs of jaw mounted components for a kit for forming a hand tool assembly. The pair of jaw mounted components at the left of the figure is shown as the first jaw mounted component 102 and the second jaw mounted component 202 as discussed above with reference to FIGS. 1-13. The pair of jaw mounted components at the right of the figure is shown as a third jaw mounted component 302 and a fourth jaw mounted component 402. The third and the fourth jaw mounted components 302 and 402 in the embodiment shown are substantially similar to the first and the second jaw mounted components 102 and 202 except that a third working surface 322 of the third jaw mounted component and a fourth working surface of the fourth jaw mounted component define a second channel 342 for contacting a work-piece when the working surfaces 322 and 422 of the jaw mounted components 302 and 402 are placed in direct opposition to one another. As shown in the embodiment of FIG. 20, the second channel has a diameter that is larger than the diameter of the channel 142. The kit for forming a hand tool assembly includes at least the first and the second jaw mounted components 102 and 202 and the third and the fourth jaw mounted component 302 and 402 and also includes at least one pair of pivotable jaws, such as the vice grip 108 of FIG. 1.

A method for operating the hand tool assembly 100 includes a user opening the pair of pivotable jaws 106 by manipulating the handle 110 of the vice grip 108. The user then affixes the first jaw mounted component 102 and the second jaw mounted component 202 to the respective jaws 112 and 114 of the vice grip 108. To perform this function, the user selects a jaw mounted component (such as the first jaw mounted component 102), places the slot 124 with the stop 132 facing away from a jaw (such as the first jaw 112), aligns the slot bottom 126 with the first jaw 112, slides the first jaw mounted component 102 along the first jaw 112 mating surface, and continues sliding the first jaw mounted component 102 until the stop meets the tip 136 of the first jaw 112. The same process is repeated to affix the second jaw mounted component 202 to the second jaw 114. The stop 132 provides automatic longitudinal positioning of the jaw mounted components 102 and 202 on the jaws 112 and 114. The magnet 138, the slot 124, and the first threaded member 146 extending within the first channel 142 provide the lateral, firm, and fixed positioning of the mating surfaces between the jaw mounted component 102 and 202 and the pivotable jaws 106.

Once each of the jaw mounted components 102 and 202 is affixed to the vice grip 108, the user can immediately leverage the multiple uses of the hand tool assembly 100, such as holding, stabilizing, cutting, crimping, and shaping of tubular work-pieces. In the workplace, a user will frequently need to cut tubing. For example, a plumber that needs to cut copper tubing can employ a conventional vice grip to perform this function rather than carry an additional special purpose tool. The user simply places the tube longitudinally within the channel 142 and locks the vice grip 108 in conventional fashion. Once the vice grip 108 is locked, the force exerted from the pivotable jaws 106 of the vice grip 108 is transferred along the channel defining working surfaces 122 and 222 of the first and the second jaw mounted components 102 and 202 and the outer surface of the tube, providing a holding force capable of withstanding rotational forces associated with tube cutting. The vice grip 108, along with the tube firmly held and stabilized by the jaw mounted components 102 and 202, can be conveniently held by the user with one hand. Using the other hand, the user is able to deploy conventional tube cutting tools to complete conventional tube cutting functions. Once the tube is cut, the user unlocks the vice grip 108, removes the tube from the jaw mounted components 102 and 202, and continues to the next cutting project.

Another function facilitated by the proposed invention is the reshaping or resizing of tubing. A common problem experienced in the field today is that a user may need to place a ferrule or coupling on a tube to extend and mate separate tube lengths, but the tubes themselves may not be perfectly round, thereby prohibiting the ferrule or coupling from sliding over the tube end. In these circumstances, the hand tool assembly 100 provides the shaping function necessary to permit resolution of this problem. Similar to the cutting function described above, the user places the deformed tube longitudinally within the channel 142 and locks the vice grip 108 in conventional fashion. With the deformed or out-of-round section of the tube placed directly between the jaw mounted component 102 and 202, the user locks the jaw mounted components around the out-of-round section of tube. Because the material used in the jaw mounted components 102 and 204 is harder than the tube material, the compressive force of the jaw mounted components 102 and 202, combined with the compressive force of the pivotable jaws 106 encircling the tube, molds the tube back into a circular form consistent with the channel 142. Once the tube is re-rounded, resized, or reshaped, the user unlocks the vice grip 108, removes the tube from the jaw mounted components 102 and 202, and continues to the next project. As in the cutting function described above, each of the shaping and/or resizing functions are accomplished by adapting a conventional tool and without the need for carrying separate, specialty tube reshaping or resizing tools.

In the event the tube material fails to be re-formed consistent with the channel 142, the tube can be resized or reshaped in conventional fashion. With the tube held, positioned, and stabilized within the jaw mounted components 102 and 202, the hand tool assembly 100 provides the holding force necessary to withstand the excessive torque exerted upon the tube by various shaping and/or resizing tools. The vice grip 108, along with the tube firmly held and stabilized by the jaw mounted components 102 and 202, is held by the user with one hand. Using the other hand, the user deploys conventional tube shaping tools and resizing tools to complete conventional tube shaping or resizing functions. Once the tube is re-rounded, resized, or reshaped, the user unlocks the vice grip 108, removes the tube from the jaw mounted components 102 and 202, and continues to the next project.

Another function facilitated by the hand tool assembly is the crimping of tubing. Another common problem experienced in the field today is configuring and positioning tubing prior to fluxing and soldering. Metal fittings, such as angled fittings, couplings, and tees, are typically cut, and rough assembled prior to permanent attachment. Often times, it is difficult for the worker to keep the metal fittings in the precise position prior to fluxing and/or soldering. In these circumstances, it is preferable to crimp the fittings together or onto an existing section of tube to prevent the component pieces from moving prior to and during subsequent fluxing and/or soldering operations. The hand tool assembly 100 resolves this problem by providing a crimping function. Similar to the functions described above, the user places the mating pieces longitudinally within the channel 142, and locks the vice grip 108 in conventional fashion. With the mating sections of tubing placed directly between the jaw mounted components 102 and 202, the user locks the jaw mounted components around the sections of tube to be temporarily joined. The compressive force of the jaw mounted components encircling the mated tube sections provides a temporary crimp, thereby providing the user with the temporary positioning of the mated tube sections prior to fluxing and soldering. Once the sections of tube are crimped, the user unlocks the vice grip, removes the tube sections from the jaw mounted components 102 and 202, and continues to the next project. As in the other functions described above, the crimping function is achieved by adapting a conventional tool without the need for carrying a separate, specialty crimping tool.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A hand tool assembly, comprising:

a pair of pivotable jaws;

a first jaw mounted component including a first mounting portion configured to removably mount the first jaw mounted component on a first of the pair of pivotable jaws, and a first working surface generally opposite the first mounting portion; and a second jaw mounted component including a second mounting portion configured to removably mount the second jaw mounted component on a second of the pair of pivotable jaws, and a second working surface generally opposite the second mounting portion, wherein a channel defined by placing the first working surface in direct opposition to the second working surface is complementary to the outer surface of a tubular work-piece, wherein the first jaw mounted component defines a bore that opens to the channel, the bore configured to receive a member that retractably extends within the channel from the first jaw mounted component.

2. The hand tool assembly of claim 1, wherein:

the pair of pivotable jaws are formed with a magnetic material;

the first mounting portion includes a first magnet; and the second mounting portion includes a second magnet.

3. The hand tool assembly of claim 1, wherein:

the first of the pair of pivotable jaws includes a first magnet;

the second of the pair of pivotable jaws includes a second magnet;

the first mounting portion includes a first magnetic material; and the second mounting portion includes a second magnetic material.

4. The hand tool assembly of claim 1, wherein:

the bore is a threaded bore; and the member is a threaded member engaged in the threaded bore.

5. The hand tool assembly of claim 1, wherein:

first surface portions of the first working surface contact second surface portions of the second working surface when the first and second working surfaces are placed in direct opposition, the first surface portions defining a first plane;

the first mounting portion has a planar surface portion that defines a second plane; and the first plane intersects the second plane.

6. The hand tool assembly of claim 5, wherein:

the first mounting portion includes a slot having a slot bottom in opposition to the first of the pair of pivotable jaws; and the slot bottom defines the second plane.

7. The hand tool assembly of claim 6, wherein:

the pair of pivotable jaws are formed with a magnetic material; and the first mounting portion includes a first magnet positioned within a first depression in the slot bottom.

8. The hand tool assembly of claim 6, wherein:

the first mounting portion includes a stop extending from the slot bottom; and the first jaw mounted component is configured to slide relative to the first of the pair of pivotable jaws towards the pivot axis until a tip of the first of the pair of pivotable jaws contacts the stop.

9. The hand tool assembly of claim 1, wherein the channel has a diameter that is slightly less than the diameter of a commercially available tubular work-piece.

10. The hand tool assembly of claim 1, wherein the channel has a diameter that is substantially identical to the diameter of a commercially available tubular work-piece.

11. A kit for forming a hand tool assembly, comprising:

a pair of pivotable jaws;

a first jaw mounted component including a first mounting portion configured to removably mount the first jaw mounted component on a first of the pair of pivotable jaws, and a first working surface generally opposite the first mounting portion;

a second jaw mounted component including a second mounting portion configured to removably mount the second jaw mounted component on a second of the pair of pivotable jaws, and a second working surface generally opposite the second mounting portion;

a third jaw mounted component including a third mounting portion configured to removably mount the third jaw mounted component on the first of the pair of pivotable jaws, and a third working surface generally opposite the third mounting portion; and a fourth jaw mounted component including a fourth mounting portion configured to removably mount the fourth jaw mounted component on the second of the pair of pivotable jaws, and a fourth working surface generally opposite the fourth mounting portion, wherein a first channel defined by placing the first working surface in direct opposition to the second working surface is complementary to the outer surface of a first tubular work-piece, a second channel defined by placing the third working surface in direct opposition to the fourth working surface is complementary to the outer surface of a second tubular work-piece, and a diameter of the first channel is different than a diameter of the second channel, wherein the first jaw mounted component defines a first bore that opens to the first channel, the first bore configured to receive a first member that retractably extends within the first channel from the first jaw mounted component, and wherein the third jaw mounted component defines a second bore that opens to the second channel, the second bore configured to receive a second member that retractably extends within the second channel from the third jaw mounted component.

12. The kit of claim 11, wherein:

the pair of pivotable jaws are formed with a magnetic material;

the first mounting portion includes a first magnet;

the second mounting portion includes a second magnet;

the third mounting portion includes a third magnet; and the fourth mounting portion includes a fourth magnet.

13. The kit of claim 11, wherein:

the first of the pair of pivotable jaws includes a first magnet;

the second of the pair of pivotable jaws includes a second magnet;

the first mounting portion includes a first magnetic material;

the second mounting portion includes a second magnetic material;

the third mounting portion includes a third magnetic material; and the fourth mounting portion includes a fourth magnetic material.

14. The kit of claim 11, wherein:

the first bore is a first threaded bore and the first member is a first threaded member engaged in the first threaded bore; and the second bore is a second threaded bore and the second member is a second threaded member engaged in the second threaded bore.

15. The kit of claim 11, wherein:

first surface portions of the first working surface contact second surface portions of the second working surface when the first and second working surfaces are placed in direct opposition, the first surface portions defining a first plane;

the first mounting portion has a planar surface portion that defines a second plane;

the first plane intersects the second plane;

third surface portions of the third working surface contact fourth surface portions of the fourth working surface when the third and fourth working surfaces are placed in direct opposition, the third surface portions defining a third plane;

the third mounting portion has a planar surface portion that defines a fourth plane; and the third plane intersects the fourth plane.

16. The kit of claim 15, wherein:

the first mounting portion includes a first slot having a first slot bottom in opposition to the first of the pair of pivotable jaws;

the first slot bottom defines the second plane;

the third mounting portion includes a second slot having a second slot bottom in opposition to the first of the pair of pivotable jaws; and the second slot bottom defines the fourth plane.

17. The kit of claim 16, wherein:

the pair of pivotable jaws are formed with a magnetic material;

the first mounting portion includes a first magnet positioned within a first depression in the first slot bottom; and the third mounting portion includes a second magnet positioned within a second depression in the second slot bottom.

18. The kit of claim 16, wherein:

the first mounting portion includes a first stop extending from the first slot bottom;

the first jaw mounted component is configured to slide relative to the first of the pair of pivotable jaws towards the pivot axis until a tip of the first of the pair of pivotable jaws contacts the first stop;

the third mounting portion includes a second stop extending from the second slot bottom; and the third jaw mounted component is configured to slide relative to the first of the pair of pivotable jaws towards the pivot axis until the tip of the first of the pair of pivotable jaws contacts the second stop.

19. A method of operating a hand tool assembly, comprising:

opening a pair of pivotable jaws;

attaching a first jaw mounted component on a first of the pair of pivotable jaws, the first jaw mounted component including a first mounting portion configured to removably mount the first jaw mounted component on the first of the pair of pivotable jaws, and a first working surface generally opposite the first mounting portion;

attaching a second jaw mounted component on a second of the pair of pivotable jaws, the second jaw mounted component including a second mounting portion configured to removably mount the second jaw mounted component on the second of the pair of pivotable jaws, and a second working surface generally opposite the second mounting portion;

retaining a tubular work-piece in a channel defined by placing the first working surface in direct opposition to the second working surface, wherein the first working surface is placed in direction opposition to the second working surface by pivoting the pair of pivotable jaws, and the channel is complementary to the outer surface of the tubular work-piece after pivoting the pair of pivotable jaws; and extending a member within the channel from the first jaw mounted component such that the member cooperates with the outer surface of the tubular work-piece, the member received in a bore defined by the first jaw mounted component.

* * * * *